United States Patent [19]

Hartmann

[11] 4,385,557

[45] May 31, 1983

[54] DRAINAGE DEVICE FOR A FRUIT PRESS

[75] Inventor: Eduard Hartmann, Schneisingen, Switzerland

[73] Assignee: Bucher-Guyer AG, Niederweningen, Switzerland

[21] Appl. No.: 261,054

[22] Filed: May 6, 1981

[30] Foreign Application Priority Data

May 28, 1980 [DE] Fed. Rep. of Germany ..... 3020266

[51] Int. Cl.[3] ..... B30B 9/06

[52] U.S. Cl. ..... 100/107

[58] Field of Search ..... 100/107, 108, 109, 104, 100/126; 426/495

[56] References Cited

U.S. PATENT DOCUMENTS 3,103,164 9/1963 Willmes ..... 100/107

3,207,064 9/1965 Hauser-Bucher ..... 100/107

*Primary Examiner*—Peter Feldman

*Attorney, Agent, or Firm*—Ernest F. Marmorek

[57] ABSTRACT

In a press for obtaining juice from agricultural products having a container, a press plate and a reaction press plate movable relative to one another within the container, a plurality of longitudinal drainage lines connecting the press plates, and wherein each line has a predetermined drainage capability and includes a flexible central core and a sleeve of a material acting as a filter surrounding the central core, at least one of the drainage lines includes a drainage element extending therefrom, so that the drainage capability of the drainage line is increased beyond the predetermined drainage capability.

14 Claims, 5 Drawing Figures

DRAINAGE DEVICE FOR A FRUIT PRESS

BACKGROUND OF THE INVENTION

Experiments performed on presses of a conventional type, such as the press disclosed in German patent Nos. DE-12 78 883, and DE-16 27 841 have shown that the output can only be increased by increasing the number of the flexible drainage lines, if the press chamber is increased by the same ratio. The optimal number of drainage lines is therefore dependent on the volume of the press, and if an optimum number of drainage lines is selected, an optimum dejuicing results from the start of the pressing operation till its end. This fact is an apparent contradiction in view of the fact, that the goods to be drained from juice, and dispersed between the drainage lines may be optimally dejuiced only in a relatively narrow region near the drainage lines, while the remainder of the goods to be drained just about retain their liquids during dejuicing. Addition of any additional drainage lines would not, however, lead to any useful result, according to past experience, and would only lead to further difficulties during loosening of goods drained of juice. By an increased number of drainage lines within the press chamber the mixing affect of pressed mash to partly pressed and fresh mash is reduced.

In such a case a better dejuicing is not possible, even if the pressure of the pressing operation is increased. Although additional juice can be obtained this way, the mash is simultaneously "overpressed", so that a pulp-like substance results, which leads to an undesired clouding of the juice.

Based on the fact, that the mash may be optimally and gently dejuiced only in a relatively thin layer around the drainage lines, a volumemetrically higher juice exploitation may also be obtained, if the number of press cycles is increased, and if the pressed goods are intensively loosened between the individual press operation. This method of operation is, however, uneconomical in view of the fact that the pressing operation is considerably prolonged.

SUMMARY OF THE INVENTION

It is therefore one of the principal objects of the invention to further develop a drainage device of the aforedescribed kind, so that a higher degree of juice exploitation is obtained, without increasing the pressing process duration, or impairing the quality of the pressed juice.

This object is attained, according to the present invention, by at least some of the drainage lines being provided with drainage elements substantially radially extending therefrom, thus increasing their drainage capability.

It has been shown that with the aid of these drainage elements the dejuicing region of the drainage lines may be considerably increased up to the region of the respective adjacent drainage line. The juice output may be effectively increased in this manner, without resorting to higher pressures, which would impair the quality of the juice, or else would increase the number of press cycles in an uneconomical manner.

In an advantageous implementation of the invention the drainage elements are implemented by flexible strips of textile material, or strings extending from the sleeve of the drainage lines, and having a filtrating and channelizing effect. From a manufacturing point of view it is very advantageous, if the strips forming the drainage elements are formed by folded sheaths, which are connected with the sleeves of the drainage lines. For the same reason it is advantageous, if each sheath is made of material similar to the material of the sleeve, and has a similar thickness. It is also advantageous if the flexible central core has a first circumference and the sleeve has a second circumference larger than the first circumference, so as to permit the formation of a fold upon tightening the sleeve around the central core, so that the folded sheath may be attached to the fold.

It is also advantageous, if the drainage element includes a kernel connected to the flexible central core, and wherein the flexible central core has a plurality of channels, and the kernel has a plurality of longitudinal grooves communicating with at least one of the channels. The kernel may have a variety of cross sections, such as a substantially round cross section, or a substantially oval cross-section, or a cross-section substantially in the shape of a polygon.

It is particularly advantageous if the sheath surrounds the kernel and is connected to the sleeve, although the kernels, on their own, increase the dejuicing effect.

BRIEF DESCRIPTION OF THE DRAWING

For a fuller understanding of the nature and objects of the invention, reference should be had to the following detailed description, taken in connection with the accompanying drawings, in which.

DESCRIPTION OF THE PREFERRED EMBODIMENT

Figure 1:
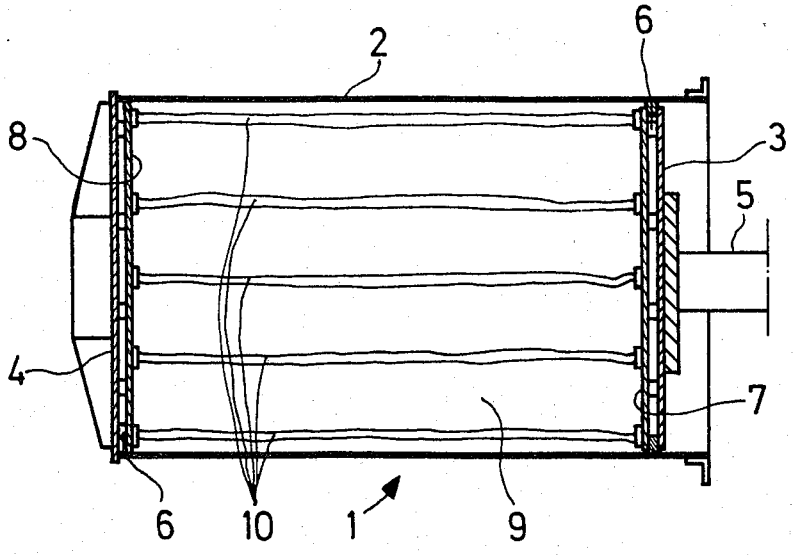
FIG. 1 is a longitudinal section of a press of the prior art, employing conventional drainage lines.

Referring now to the drawing, and particularly to FIG. 1, a press 1 includes a press cylinder 2, in which a press plate 3 is movable in relation to the reaction press plate 4 by the action of a pressure piston 5 through a (non-illustrated) hydraulic piston-cylinder system. Plates 7 and 8 are spaced from press plates 3 and 4, respectively, through distance pieces 6. The press plate 3 and the reaction press plate 4, together with the plates 7 and 8 border the chamber 9 of the press 1. A drainage system in the form of a plurality of drainage lines 10, which terminate on respective plates 7 and 8, and extend approximately parallel to one another, and to the axis of the press cylinder, serve to re-route the juice, during a pressing operation, to the juice collecting chamber situated between the press plate 3 and the reaction press plate 4, and the respective plates 7 and 8, from which the juice is obtained in a manner not further illustrated; the juice is obtained, for example, by implementing the press in a manner disclosed in German Pat. No. DE-AS 1761986. When each pressing operation is concluded, the drainage lines 10 serve as tension members, which loosen the pressed goods, when the press plates 3 and 4 move away from one another.

Figure 2:
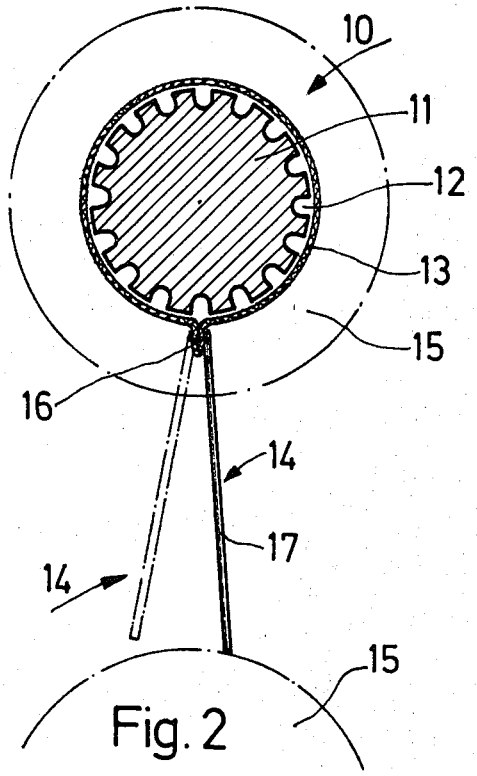
FIG. 2 is a section through a drainage line, according to the present invention, employing additional drainage elements.

FIG. 2 shows one of the drainage lines 10 in enlarged cross-section. It consists of a flexible center core 11, which is formed with drainage channels 12 on its circumference. These extend along the longitudinal direction of the core 11. The core 11 is surrounded by a sleeve 13 of filtrable material, which is drawn prior to the insertion of the drainage line 10 into the press 1 over the core 11. For a better understanding, the sleeve 13 consisting of knitted material, is illustrated at a small spacing from the core 11. During pressing operations it will be understood that the sleeve 13 is adjacent to the core 11. During pressing of the pressed goods, preferably in the form of a mash, the resulting juice penetrates the filtering sleeve 13 and passes into the drainage channels 11, and the juice chambers provided for near the attachment ends of the drainage lines 10.

In order to improve the drainage effect, a drainage element 14 is connected to the circumference of the sleeve 11, which, according to the interpretation of FIG. 2, consists of textile strips 17 of knitted material providing a fluid path for the extracted juice. The strips 17 extend with their free end up to the dejuicing region 15 of a neighboring drainage line 10. The strips 17 are connected at their ends, which serve to attach them to the respective ends of the plates 7 and 8, by means of a seam to the sleeve 13 of the drainage lines 10. Each sleeve 13 has a circumference larger than that of the core 11, so that it is possible to form a fold 16 upon tightening of the sleeve 13 around the central core 11. The strips of textile material 17, forming the drainage element 11, are distributed around the circumference of the drainage lines 10 at substantially equal spacings. In the example illustrated, these strips 17 are formed as folded sheaths. As shown in dash-dotted-lines, the strips 17 of textile material can be attached on either side of the fold 16. They can be arranged along the drainage lines 10 at respective spacings, but a successive arrangement is also possible; drainage elements 14 in the form of textile strips or paths, which extend as a single piece approximately over the entire length of each drainage line 11, are only theoretically advantageous. In practice it has been shown that during processing of the mash, the sleeves 13 of the core 10 are often angularly displaced, so that textile strips 17 of such an arrangement become ineffective, and impair the dejuicing process.

Instead of knitted textile strips, the drainage element 14 may be also implemented as non-permeable foils, or other flexible elements of an arbitrary material, which are flat and are also formed with grooves directed towards each respective drainage line 10, so as to drain off liquid.

Figure 3:
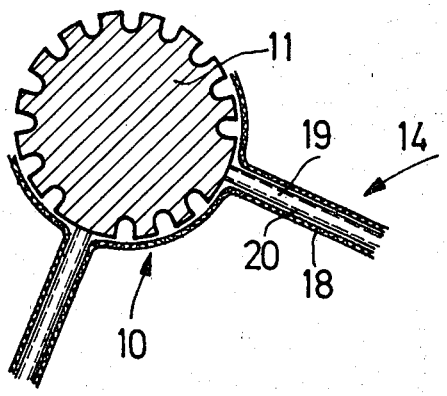
FIG. 3 is a second version of the drainage element, according to the present invention.

In the implementation, according to FIG. 3, the drainage element 14 is formed by a sheath 18 made of textile material, which surrounds a kernel 19, which in cross-section may be substantially round, or have the form of a polygon, and may be connected to the core 11 of the drainage line 10. Similarly to the core 11, the kernel 19 is formed with longitudinal grooves 20, which communicate with the channels of the drainage line 10. The kernel 19 can also be flat; however, it is necessary that it be elastic and flexible.

The kernel 19 has a favorable effect on the dejuicing even without a sheath 18.

Figure 4:
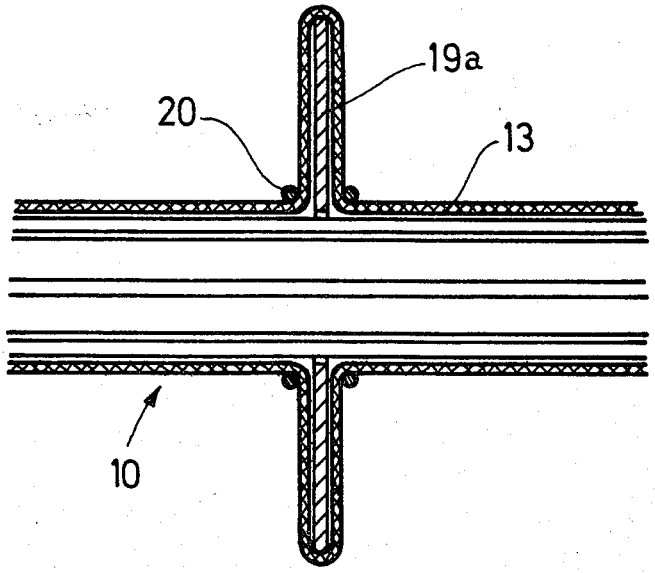
FIG. 4 is a third version of the drainage element, according to the present invention.

FIG. 4 represents a further implementation of the drainage device, in which the kernel 19*a* is formed as an apertured disc, in which the flexible central core 10 passes through that apertured disc. The kernel 19*a* is in turn surrounded entirely by the sleeve 13. The sleeve 13 extends in an outward detour around the region of the kernel 19*a*, and is secured to the drainage line 10 by means of clamps 20. The disc 19*a* is flexible or elastic.

Figure 5:
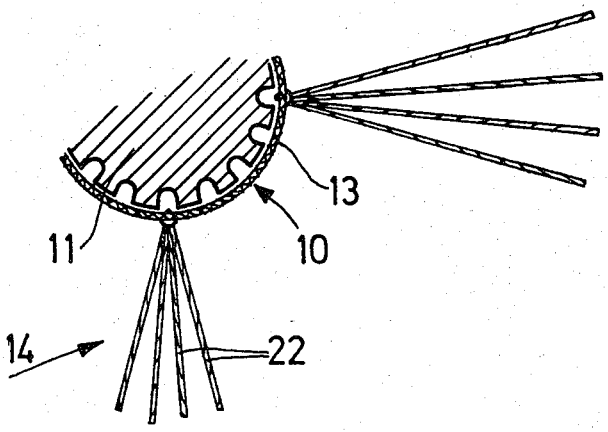
FIG. 5 is a fourth version of the drainage element, according to the present invention.

FIG. 5 shows a simple variant of the implementation according to FIG. 2, in which bunched strings 22 are employed, instead of the textile strips 17 along the periphery of the sleeve 13 of a corresponding drainage line 10, the strips 17 acting as drainage elements. The free ends of the strings 22 extend into the dejuicing region of the nearest drainage line 10.

With the aid of the drainage system described, a higher exploitation of juice in the region of 8% or more can be obtained, as verified by experiments. This fact is particularly of importance when, in the case of a relatively low exploitation, for example 59%, the juice extraction can be increased by about 20%.

At a juice extraction efficiency of about 70%, the output of the press using the inventive measures, can be increased by about 60%, or in order words, at a 75% efficiency only four presses instead of three are required.

I wish it to be understood that I do not desire to be limited to the exact details of construction shown and described, for obvious modifications will occur to a skilled person in the art.

Having thus described the invention, what I claim as new and desire to be secured by Letters Patent is as follows:

1. In a press for obtaining juice from agricultural products having a container, a press plate and a reaction press plate movable relative to one another within said container, a plurality of longitudinal drainage lines connecting said press plates, each line having a predetermined drainage capability and including a flexible central core, and a sleeve of a material acting as a filter surrounding said central core, in combination, at least one of said drainage lines including a drainage element extending therefrom, wherein said drainage element is composed of a flexible strip of textile material extending from said sleeve and acting as a filter.

2. In a press, as claimed in claim 1, wherein said drainage element extends substantially radially from said drainage line.

3. In a press, as claimed in claim 1, wherein said drainage element includes a string extending from said sleeve and acting as a filter.

4. In a press, as claimed in claim 1, wherein each drainage element includes a sheath connected to said sleeve.

5. In a press, as claimed in claim 4, wherein each sheath is made of textile material and folded along its longitudinal direction.

6. In a press, as claimed in claim 4, wherein each sheath is made of a material similar to the material of said sleeve, and has a similar thickness.

7. In a press, as claimed in claim 5, wherein said flexible central core has a first circumference, and said sleeve has a second circumference larger than said first circumference, so as to permit the formation of a fold upon tightening said sleeve around said central core, whereby said folded sheath is attached to said fold.

8. In a press for obtaining juice from agricultural products having a container, a press plate and a reaction press plate movable relative to one another within said container, a plurality of longitudinal drainage lines connecting said press plate, each line having a predetermined drainage capability and including a flexible central core, and a sleeve of a material acting as a filter surrounding said central core, in combination, at least one of said drainage lines including a drainage element extending therefrom, whereby the drainage capability of said drainage line is increased beyond said predetermined drainage capability, wherein each drainage element includes a kernel connected to said flexible central core, said flexible central core having a plurality of channels, and said kernel having a plurality of longitudinal grooves communicating with at least one of said channels.

9. In a press, as claimed in claim 8, wherein said kernel has a substantially round cross-section.

10. In a press, as claimed in claim 8, wherein said kernel has a substantially oval cross-section.

11. In a press, as claimed in claim 8, wherein said kernel has a cross-section substantially in the shape of a polygon.

12. In a press, as claimed in claim 8, wherein said kernel is flexible and substantially flat.

13. In a press, as claimed in claim 12, wherein said kernel has the shape of an apertured disk, said flexible central core passing through the aperture of said disk.

14. In a press, as claimed in claim 8, further comprising a sheath connected to said sleeve and surrounding said kernel.

* * * * *